US008776382B2

(12) United States Patent
Ochiai et al.

(10) Patent No.: US 8,776,382 B2
(45) Date of Patent: Jul. 15, 2014

(54) CUTTING INSTRUMENT

(75) Inventors: Hiroyuki Ochiai, Tokyo (JP); Mitsutoshi Watanabe, Tokyo (JP); Takashi Furukawa, Tokyo (JP); Hiroki Yoshizawa, Tokyo (JP); Yukihiro Shimoda, Tokyo (JP); Sadao Doi, Kochi (JP)

(73) Assignee: IHI Corporation, Tokyo (JP)

( * ) Notice: Subject to any disclaimer, the term of this patent is extended or adjusted under 35 U.S.C. 154(b) by 361 days.

(21) Appl. No.: 12/994,032

(22) PCT Filed: Oct. 2, 2008

(86) PCT No.: PCT/JP2008/067932
§ 371 (c)(1),
(2), (4) Date: Jun. 2, 2011

(87) PCT Pub. No.: WO2010/038300
PCT Pub. Date: Apr. 8, 2010

(65) Prior Publication Data
US 2011/0232108 A1 Sep. 29, 2011

(51) Int. Cl.
*B25G 3/00* (2006.01)
*B26B 9/00* (2006.01)

(52) U.S. Cl.
USPC ..... 30/345; 30/346; 30/346.54; 30/350

(58) Field of Classification Search
USPC ..... 30/345, 346, 357, 355, 349, 350
See application file for complete search history.

(56) References Cited

U.S. PATENT DOCUMENTS

| | | | | | |
|---|---|---|---|---|---|
| 2,319,607 | A | * | 5/1943 | Kevorkian et al. | 30/345 |
| 2,803,876 | A | * | 8/1957 | Nelson | 30/115 |
| 3,911,579 | A | * | 10/1975 | Lane et al. | 30/346.54 |
| 4,232,676 | A | * | 11/1980 | Herczog | 606/50 |
| 4,248,231 | A | * | 2/1981 | Herczog et al. | 606/50 |
| 4,419,821 | A | * | 12/1983 | Anderson | 30/276 |
| 4,622,966 | A | * | 11/1986 | Beard | 606/28 |

(Continued)

FOREIGN PATENT DOCUMENTS

| | | | |
|---|---|---|---|
| CN | 2571526 | Y | 9/2003 |
| CN | 2606665 | Y | 3/2004 |

(Continued)

OTHER PUBLICATIONS

Combined Chinese Office Action and Search Report issued Sep. 14, 2012 in Chinese Patent Application No. 200880129338.X (with partial English-language translation and English Translation of Categories of Cited Documents).

(Continued)

*Primary Examiner* — Omar Flores Sanchez
(74) *Attorney, Agent, or Firm* — Oblon, Spivak, McClelland, Maier & Neustadt, L.L.P.

(57) ABSTRACT

A cutting instrument has a cutting blade portion formed with a skin made of an electrode material or a reaction product of the electrode material, the electrode material having been molten by pulse discharges induced between the cutting blade portion and an electrode in a machining liquid or gas, having as the electrode one of a mold molded from powder of a kind or powder of a mixture of kinds out of a metal or metals, a metal compound or metal compounds, and a ceramic or ceramics, and a heat-treated mold being the mold as heat-treated.

13 Claims, 8 Drawing Sheets

(56) References Cited

U.S. PATENT DOCUMENTS

| | | | | |
|---|---|---|---|---|
| 5,077,901 | A * | 1/1992 | Warner et al. | 30/357 |
| 5,181,321 | A * | 1/1993 | Gouttebarge | 30/357 |
| 5,573,534 | A * | 11/1996 | Stone | 606/48 |
| 5,787,591 | A * | 8/1998 | Lu | 30/355 |
| 5,795,648 | A * | 8/1998 | Goel et al. | 428/336 |
| 6,427,572 | B2 * | 8/2002 | Ciani et al. | 83/676 |
| 6,974,452 | B1 * | 12/2005 | Gille et al. | 606/37 |
| 7,060,367 | B2 * | 6/2006 | Yamada et al. | 428/634 |

FOREIGN PATENT DOCUMENTS

| | | | |
|---|---|---|---|
| CN | 1826478 | A | 8/2006 |
| CN | 101142046 | A | 3/2008 |
| EP | 1 035 231 | A1 | 9/2000 |
| JP | 41-24479 | | 12/1966 |
| JP | 57-15373 | | 1/1982 |
| JP | 59-34772 | | 3/1984 |
| JP | 61 141386 | | 6/1986 |
| JP | 61 159982 | | 7/1986 |
| JP | 62-181836 | | 8/1987 |
| JP | 63 166166 | | 10/1988 |
| JP | 3 65558 | | 6/1991 |
| JP | 6 146007 | | 5/1994 |
| JP | 6-506613 | | 7/1994 |
| JP | 8 289984 | | 11/1996 |
| JP | 10-127958 | | 5/1998 |
| JP | 11-99287 | | 4/1999 |
| JP | 11 300534 | | 11/1999 |
| JP | 2001-293266 | | 10/2001 |
| JP | 2001 329382 | | 11/2001 |
| JP | 2002 248278 | | 9/2002 |
| JP | 2005-2880 | | 1/2005 |
| JP | 2005-214147 | | 8/2005 |
| JP | 2005-273779 | | 10/2005 |
| JP | 2006 25928 | | 2/2006 |
| JP | 3137994 | | 12/2007 |
| JP | 2008-183094 | | 8/2008 |
| RU | 2 259 267 | C2 | 3/2004 |

OTHER PUBLICATIONS

Office Action issued on Nov. 29, 2011 in the counterpart Japanese Patent Application No. 2007-109402 (with English Translation).

Office Action issued on Nov. 29, 2011 in the counterpart Japanese Patent Application No. 2009-537426 (with English Translation).

Decision on Grant issued Feb. 14, 2012 in Russian Application No. 2010147376/02.

International Search Report issued Oct. 28, 2008 in PCT/JP08/067932 filed Oct. 2, 2008.

Japanese Office Action issued Jun. 4, 2013, in Japan Patent Application No. 2012-017026 (with English translation).

* cited by examiner

FIG. 13

| | | TREATMENT CONDITIONS | | | |
|---|---|---|---|---|---|
| ie*te/ui^0.7 | ROUGHNESS (Ra) | ui (V) | ie (A) | te (μs) | to (μs) |
| 9.31 | 1.56 | 80 | 25 | 8 | 256 |
| 3.53 | 1.22 | 320 | 25 | 8 | 256 |
| 2.93 | 1.03 | 220 | 16 | 8 | 256 |
| 2.98 | 1.03 | 80 | 16 | 4 | 256 |
| 2.33 | 0.99 | 80 | 25 | 2 | 256 |
| 1.47 | 0.84 | 220 | 16 | 4 | 256 |
| 2.98 | 0.8 | 80 | 8 | 8 | 256 |
| 2.29 | 0.76 | 220 | 25 | 4 | 256 |
| 1.13 | 0.76 | 320 | 16 | 4 | 256 |
| 0.73 | 0.76 | 220 | 8 | 4 | 256 |
| 0.88 | 0.72 | 320 | 25 | 2 | 256 |
| 0.74 | 0.69 | 80 | 8 | 2 | 256 |
| 1.13 | 0.57 | 320 | 8 | 8 | 256 |
| 0.73 | 0.5 | 220 | 16 | 2 | 256 |
| 0.28 | 0.46 | 320 | 8 | 2 | 256 |

CUTTING INSTRUMENT

TECHNICAL FIELD

The present invention relates to a cutting instrument, and particularly, to a cutting instrument having a cutting blade portion formed with a skin comprised of a substance reacted by discharge energy.

BACKGROUND ART

There have been known knives including those made of ceramics (Japanese Patent Application Laying-Open Publication No. 61-159982), those having a high hardness skin formed at a blade edge by a thermal spray, those having a high hardness skin formed at a blade edge by a PVD (physical vapor deposition) or CVD (chemical vapor deposition), and those made of a stainless steel quenched at a blade edge.

SUMMARY OF THE INVENTION

Among them, those knives made of ceramics were low in toughness, with tendencies to break as they hit something hard. In those knives having a high hardness skin formed at a blade edge by a thermal spray, the skin might have poor adhesion to the blade core (e.g. ferritic stainless steel fabricated blade core), with a potential detachment in a long service.

In those knives having a high hardness skin formed at a blade edge by a PVD or CVD, the skin was smooth at the surface, so the knives might not cut well with adhering slices. Further, the skin was thin, with a difficulty to grind (re-grind) to reproduce sharpness.

Those knives made of a stainless steel quenched at a blade edge were subject to a difficult thermal control to make the blade edge hardness high, with a low yield. There have been knives having a hard thin material (e.g. stainless steel quenched or adapted for quench) as a blade edge sandwiched between soft thin materials (e.g. ferritic stainless steel) for integration with a complicate structure, with necessary time and labor.

In any knife described, for increased sharpness, the blade edge tip was to be serrated very fine by a grinding that was difficult and committed to an expert in most cases.

Such being the case, those knives described have difficulties in fabrication or to make sharp or retain sharpness for a long time, as issues. There have been cutting instruments else than the knives attended with such difficulties appearing as similar issues.

The present invention has been devised in view of such issues. It therefore is an object of the present invention to provide a cutting instrument allowing for a facilitated fabrication, ensured sharpness, and long retained sharpness.

According to a principal aspect of the present invention, there is a cutting instrument including a blade core and a cutting blade portion, the cutting instrument comprising a skin formed in at least part of the cutting blade portion inclusive of a blade edge tip, the skin comprising an electrode material or a reaction product of the electrode material, the electrode material having been molten by pulse discharges induced between the blade core and an electrode in a machining oil, having as the electrode one of a mold molded from powder of at least one of a metal, a compound of metal, and a ceramics, a heat-treated mold being the mold as heat-treated, and a solid body of Si, and a gradient composition metal formed between the blade core and the skin, with depths within a range of 5 μm to 30 μm.

BRIEF DESCRIPTION OF DRAWINGS

FIG. 13 is a listing of roughness Ra of skins formed under various peak currents ie, pulse widths te, and no-load voltages ui.

DESCRIPTION OF EMBODIMENTS

First Embodiment

Figure 1:
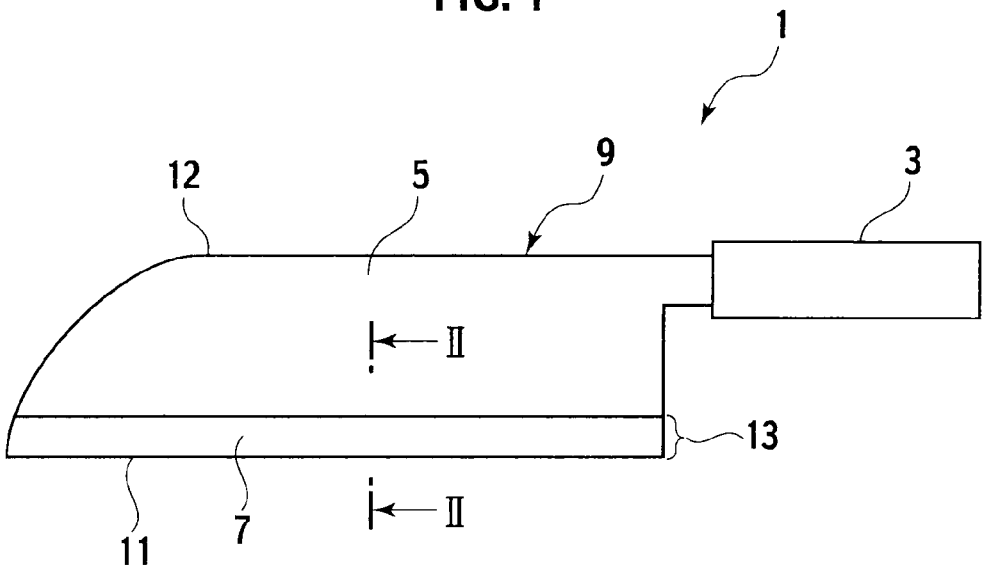
FIG. 1 is a schematic illustration of configuration of a knife according to a first embodiment of the present invention.
Figure 2:
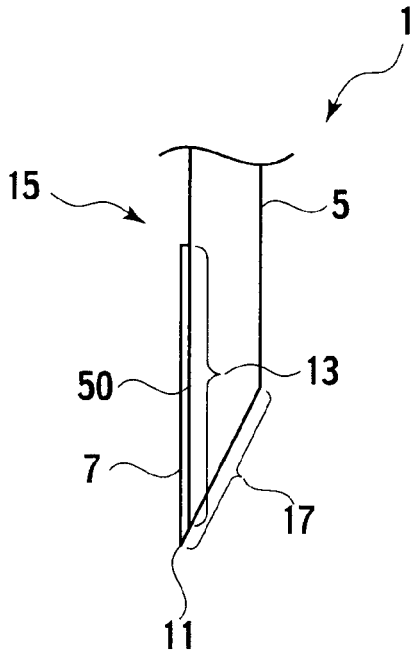
FIG. 2 is a sectional view along line II-II of FIG. 1.

FIG. 1 is a schematic illustration of configuration of a knife 1 according to a first embodiment of the present invention, and FIG. 2, a sectional view along line II-II of FIG. 1.

The knife 1 is configured with a hilt 3, and a blade 9 including a blade core 5 (e.g. ferritic stainless steel fabrication) provided with a cutting blade portion 13. According to this embodiment, the cutting blade portion 13 is provided simply on a blade backside 15 of the knife 1. The cutting blade portion 13 has a tip of blade edge 11 (as an edged line) at the end. At an opposite end to the edge tip 11 of the blade 9, there is a blade spine 12. Further, at least part of the cutting blade portion 13 inclusive of the blade edge tip 11 has a skin 7 thin-formed thereon like a belt extending in a longitudinal direction of the knife 1.

It is noted that the region of skin 7 formed on the blade backside 15 may extend beyond the cutting blade portion 13 (e.g. over an area at the blade backside 15 of the blade core 5). That is, the knife 1 can do with a skin 7 formed on at least the cutting blade portion 13 at the blade backside 15.

There is a mold molded from a powder of a metal or metals or a powder of a kind or a mixture of kinds of ceramics or metal compound or metal compounds, a heat-treated mold being the above-noted mold as heat-treated, or a solid body of Si (silicon), employed as an electrode (non-depicted) to have pulse discharges induced between the cutting blade portion 13 and the electrode in a machining oil or gas, with evolution of discharge energy melting a material or materials of the electrode, involving discharge energy causing the electrode material(s) to react, having resultant material(s) or product(s) deposited little by little on the cutting blade portion 13, thereby forming the skin 7 as a composite mixed with a material or materials of the blade core.

There is a gradient composition metal 50 formed between the blade core 5 and the skin 7. The gradient composition metal 50 is formed with depths within a range of 5 μm to 30 μm. It is noted that in the following embodiments, as well, there is a gradient composition metal 50 formed between blade core 5 and skin 7.

For discharges to be induced, the electrode is spaced from the cutting blade portion 13 at a distance of 0.05 mm or near, for instance. As will be seen from FIG. 1, there may be an electrode having a small area in comparison with an area of the cutting blade portion 13, for instance, and being displaced in the longitudinal direction of knife 1, while discharging.

The electrode employed may be a ceramic powder compressed for instance to mold a porous mold, involving one or more kinds out of a group of hard ceramics (metal compounds) such as cBN (cubic boron nitride), TiC (titanium carbide, titanium carbides), WC (tungsten carbide, tungsten carbides), SiC (silicon carbide, carborundum), $Cr_3C_2$ (chromium carbide, chrome carbide), $Al_2O_3$ (aluminum oxide, almina), $ZrO_2$—Y (stabilized zirconium oxide, stabilized zirconium), TiN (titanium nitride, titanium nitrides), and TiB (titanium boride, titanium borides). Such the mold may be heat-treated in a vacuum furnace, for instance, to fabricate another mold to be employed. The skin 7 may thus be made of an identical material or identical materials to such the electrode and/or a compound or compounds thereof combined in a discharge atmosphere.

For electrodes to be non-conductive, there may be combination of a fine powder of a metal or metals and a fine powder of ceramics, mixed and bound together to form an electrode for deposition. There may be a fine powder of ceramics compressed to provide a mold as an electrode for deposition with a surface-coating conductive material.

In place of the electrode described, there may be a fine powder of metal such as Si or Ti (titanium) having a tendency to produce carbide, compressed to mold, and heated as necessary for the compression-molded metal powder to be treated, to form a compact, to provide as an electrode to be made. That is, there may be a fine powder of metal such as Si or Ti having a tendency to produce carbide, bound together to form a porous electrode. In this case, there may be discharges induced between the electrode and the cutting blade portion 13 put in a machining oil containing carbon hydride, such as a kerosene, with evolution of discharge energy causing reactions, having resultant substances (such as a substance containing SiC or TiC) forming a skin 7 on a surface of the cutting blade portion 13.

Moreover, instead of making a compression molding, the electrode may be formed by a slip casting, MIM (metal injection molding), spray molding (molding by a thermal spray), or such.

Further, instead of porous electrodes formed by bonding fine metal powder of Si, there may be use of an electrode made of Si in the metallic state (crystal of Si free of internal voids).

The skin 7 has a surface thereof roughened as necessary to form a fine serrated blade edge tip. The roughness is controlled as the skin 7 is formed. After formation of the skin 7, there may be a grinding or polishing to a skin-less blade front side or the blade backside, to trim the edge roughness (for instance, at a surface 17 on the blade front side), or sharpen the edge. For increased sharpness, the surface roughness of skin 7 may be adjusted in accordance with a kind of target to be cut or sliced (that may be e.g. fish, meat, or vegetable).

For the skin 7 thus formed, description is now made of a method of controlling the surface roughness.

Figure 11:
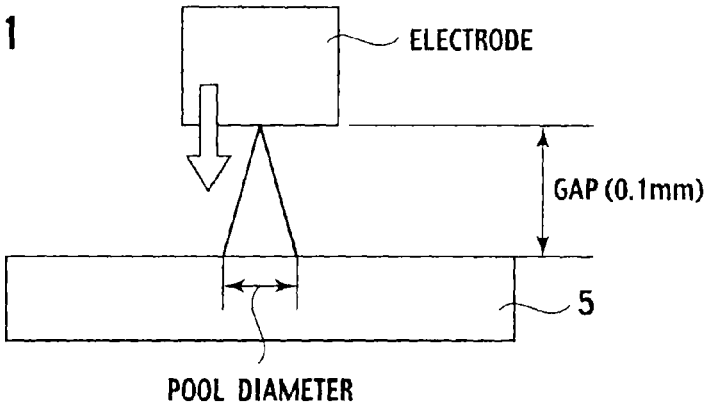
FIG. 11 is a schematic diagram of a cutting blade portion in a process of forming thereon a skin made of substances such as those produced by reactions of electrode materials caused by discharge energy.

FIG. 11 is a schematic diagram of a cutting blade portion in a process of forming thereon a skin made of substances such as those produced by reactions of electrode material caused by discharge energy.

Figure 12:
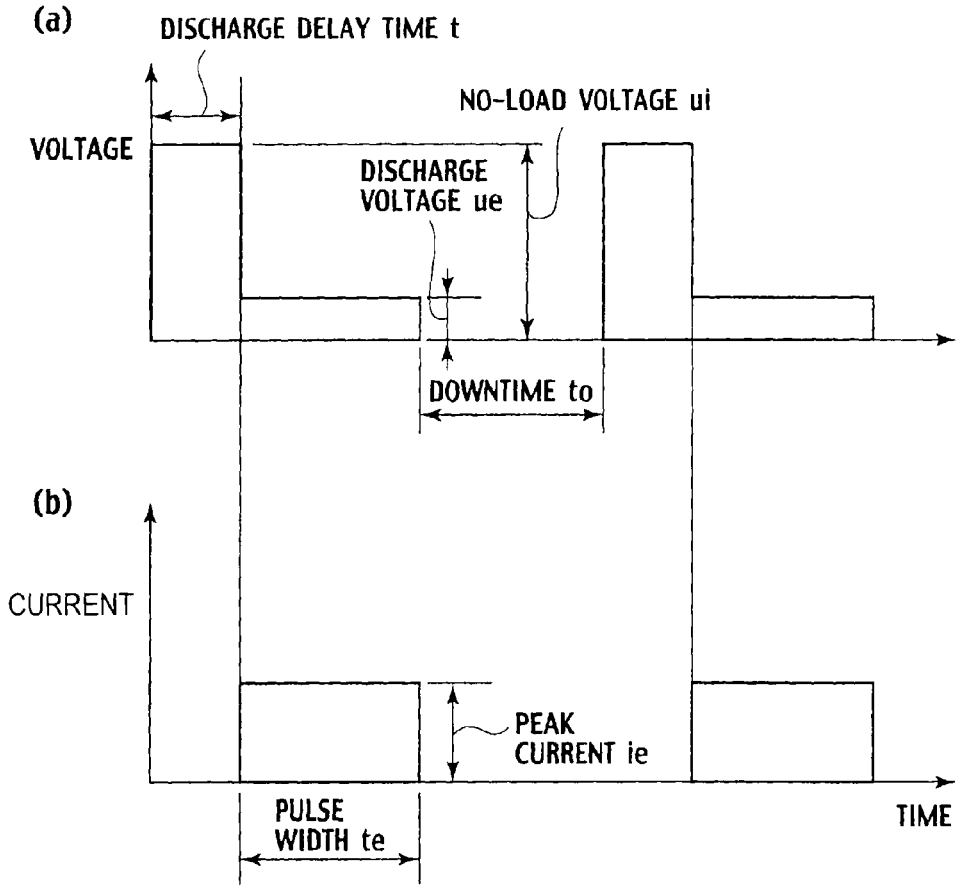
FIG. 12 is a pair of graphs showing relationships with respect to a voltage and a current between an electrode and a work (a blade core) to be processed in FIG. 11, in which FIG. 12(*a*) shows a relationship between voltage and discharge time, and FIG. 12(*b*) shows a relationship between current and discharge time.

FIG. 12 is a pair of graphs showing relationships with respect to a voltage and a current between an electrode and a work (as a blade core 5) in the process of FIG. 11, in which FIG. 12(*a*) has its axis of ordinate indicating the voltage (as a voltage applied to the electrode from a power supply), FIG. 12(*b*) has its axis of ordinate indicating the current (as a current conducted between the electrode and the work), and FIG. 12(*a*) and FIG. 12(*b*) have their axes of abscissa indicating a time.

The skin 7 has a different surface roughness depending on an amount of energy per unit quantity of fine powder particles showered from the electrode, so the greater the energy amount the more roughened the surface of skin 7.

More specifically, there is evolution of energy per one shot of discharge (one time of discharge from the electrode) that is proportional to the product of a discharge voltage ue, a peak current ie, and a pulse width te shown in FIGS. 12(*a*) and 12(*b*). It is now assumed that the performance of the power supply causing discharges affords to hold the discharge voltage ue little dependent on the current, and constant.

The quantity of fine powder particles showered from the electrode is dependent on an energy amount (no-load voltage ui) at the start of discharge, and little affected by others. The quantity of fine powder particles showered from the electrode is proportional to an approximately 0.7-th power of the no-load voltage ui.

Accordingly, the amount of energy per unit quantity of fine powder is proportional to the product of the peak current ie and the pulse width te, divided by an approximately 0.7-th power of the no-load voltage ui.

Therefore, if the peak current ie and the pulse width te are increased and if the no-load voltage ui is decreased, then the amount of energy per unit quantity of fine powder particles showered from the electrode is increased, allowing for a roughened coating (for the skin 7 to have an increased surface roughness). On the other hand, if the peak current ie and the pulse width te are decreased and if the no-load voltage ui is increased, then the amount of energy per unit quantity of fine powder particles showered from the electrode is decreased, allowing for a fine-grained coating (for the skin 7 to have a decreased surface roughness).

FIG. 13 is a listing of roughness Ra of skins 7 formed under various peak currents ie, pulse widths te, and no-load voltages ui.

It will be seen from FIG. 13 that the surface roughness of skin 7 was increased with increase in value of the product of peak current ie and pulse width te divided by a 0.7-th power of no-load voltage ui.

Such being the case, the knife 1 has a ferritic stainless steel fabricated blade core 5 that includes a cutting blade portion 13 formed with a high hardness skin (as a hardly wearing skin) 7, allowing for favorable sharpness. The blade core 5 is tough, so the entirety of knife has a high toughness, affording to have an increased tendency to prevent breakage when hitting or fallen. With high adhesion to the blade core 5, the skin 7 is kept from being detached in a long service, allowing for long retained sharpness.

It also is facilitated to roughen surfaces of the skin 7, as necessary, affording to have a blade edge tip 11 serrated with fine undulations, allowing for an enhanced sharpness, with suppressed adhesion of slices on the knife 1. It also is possible to re-grind the blade backside or blade front side free of skin 7, to reproduce a sharp blade edge tip serrated with undulations commensurate with the surface roughness of skin 7.

Moreover, the blade 5 configured with a skin 7 has a simplified configuration that is exclusive of a troublesome quenching process, allowing for an enhanced yield with a facilitated fabrication.

Further, as the skin 7 is formed simply on a blade backside 15, the knife 1 can be re-ground simply at a blade front side 17 (as a skin-free side, or a ferritic stainless steel side) where the cutting blade portion 13 is gradient, to reproduce a sharp (re-sharpen) blade edge serrated with undulations commensurate with the surface roughness of skin 7.

Second Embodiment

Figure 3:
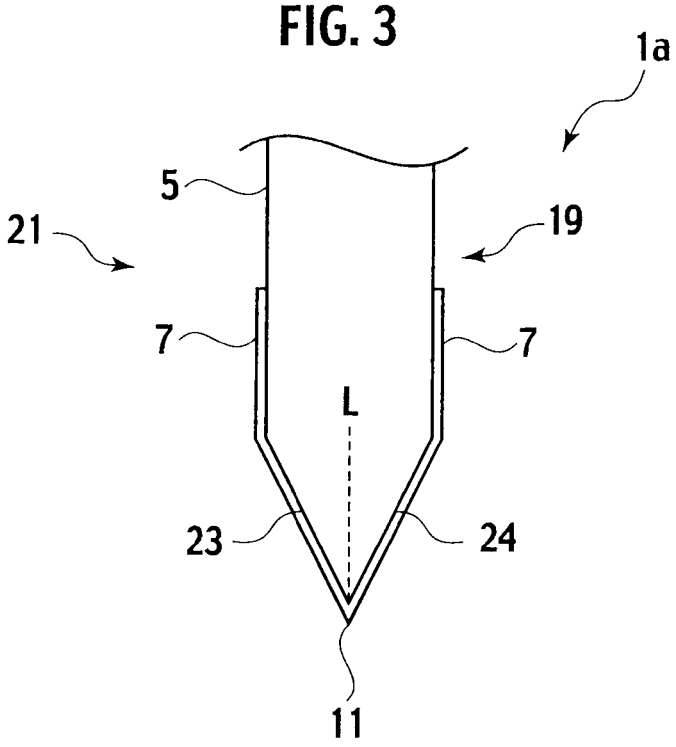
FIG. 3 is a schematic illustration in section of configuration of a knife according to a second embodiment of the present invention.

FIG. 3 is a schematic illustration in section of configuration of a knife 1*a* according to a second embodiment of the present invention.

According to the second embodiment, the knife 1*a* is different from the knife 1 according to the first embodiment, in that it has a double bevel blade, with skins 7 formed on both sides (a first blade side 19 and a second blade side 21) of the blade. The first and second blade sides 19 and 21 of the knife 1*a* have beveled cutting blade portions 24 and 23, respectively, arranged symmetric to a centerline L in section of the blade core 5 that is perpendicular to a longitudinal direction of the knife 1*a*. The skins 7 are thin-formed on the first blade side 19 with the cutting blade portion 24 inclusive, and on the second blade side 21 with the cutting blade portion 23 inclusive, like a pair of belts extending along the longitudinal direction of the knife 1*a*. For other aspects, the configuration is similar to the knife 1, rendering substantially similar effects to the knife 1.

The knife 1*a* thus has a double bevel blade with wearing-resistant skins 7 formed on both the first and second blade sides 19 and 21, allowing for a retained sharpness over the longer term. Should the edge be broken, if any, it can be re-ground, at a sacrifice of one skin to be removed, to implement similar effects to modifications having a skin 7 formed simply on a first or a second blade side 19 or 21.

Figure 4:
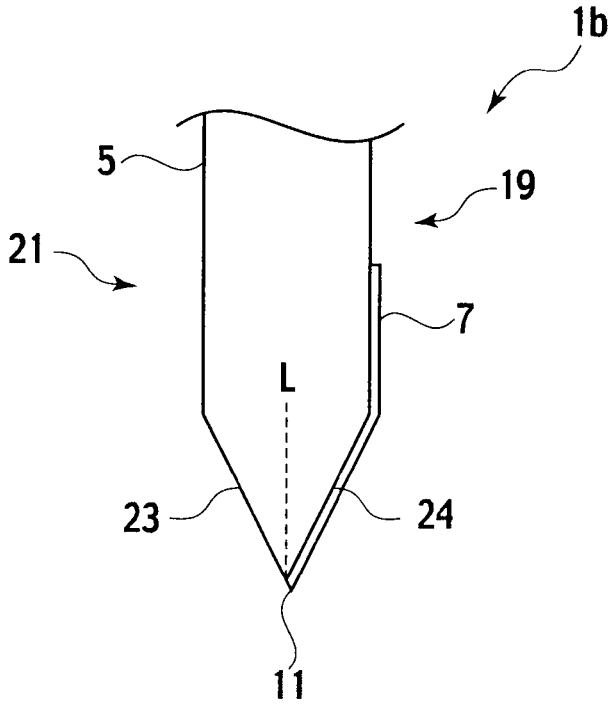
FIG. 4 is a schematic illustration in section of configuration of a knife according to a first modification of the second embodiment.

FIG. 4 is a schematic illustration in section of configuration of a knife 1*b* according to a first modification of the knife 1*a*. The knife 1*b* has first and second blade sides 19 and 21 including beveled cutting blade portions 24 and 23, respectively, arranged symmetric to a centerline L in section of a blade core 5 that is perpendicular to a longitudinal direction of the knife 1*b*. There is a skin 7 thin-formed simply on the first blade side 19 with the cutting blade portion 24 inclusive, like a belt extending along the longitudinal direction of the knife 1*b*. Though being non-depicted, there may be a thin belt-shaped skin 7 formed simply on the second blade side 21 with the cutting blade portion 23 inclusive. Namely, it can do with a skin 7 formed on a blade side, whether the first blade side 19 or the second blade side 21.

The knife 1*b* thus has a skin 7 formed simply on the first or the second blade side 19 or 21, affording to reproduce sharpness with ease, like the embodiment of a single bevel knife 1 having a skin 7 formed simply on a blade backside 15.

It is noted that in use for cutting foods such as vegetables, the knife 1*b* may make slant cuts due to a difference between a coefficient of friction of the cutting blade portion 24 on the first blade side 19, where the skin 7 is formed, and a coefficient of friction of the cutting blade portion 23 on the second blade side 21. This issue will be solved in the following second to fifth modifications.

Figure 5:
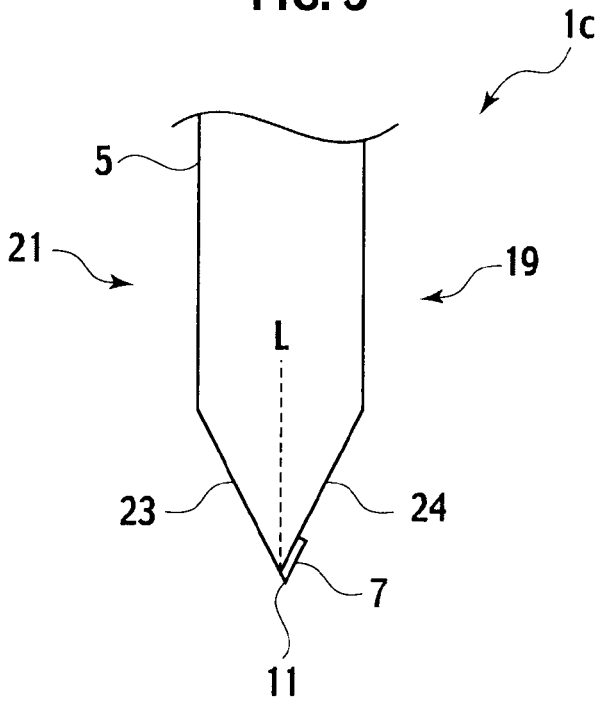
FIG. 5 is a schematic illustration in section of configuration of a knife according to a second modification of the second embodiment.

FIG. 5 is a schematic illustration in section of configuration of a knife 1*c* according to a second modification of the knife 1*a*. The knife 1*c* has first and second blade sides 19 and 21 including beveled cutting blade portions 24 and 23, respectively, arranged symmetric to a centerline L in section of a blade core 5 that is perpendicular to a longitudinal direction of the knife 1*c*. There is a thin skin 7 formed simply on a tip region of the cutting blade portion 24 at the first blade side 19, like a stripe extending along the longitudinal direction of the knife 1*c*.

Figure 6:
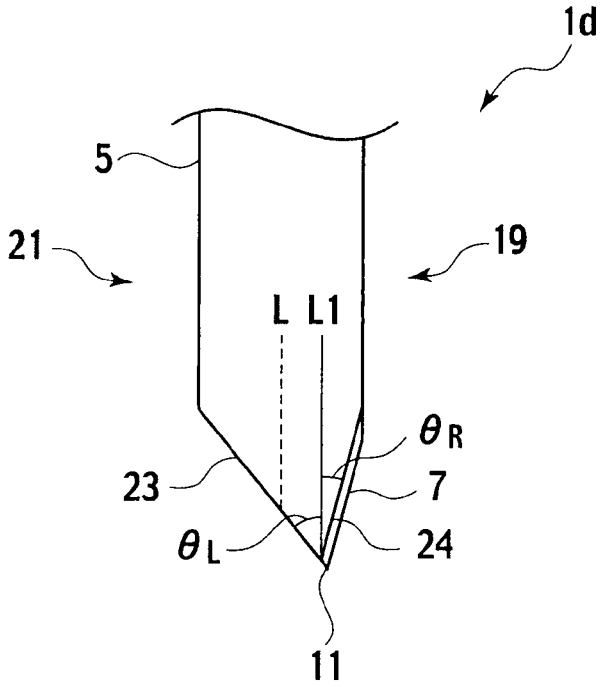
FIG. 6 is a schematic illustration in section of configuration of a knife according to a third modification of the second embodiment.

FIG. 6 is a schematic illustration in section of configuration of a knife 1*d* according to a third modification of the knife 1*a*. The knife 1*d* has a blade edge tip 11 disposed on a line L1 that is offset toward a first blade side 19 from a centerline L in section of a blade core 5 perpendicular to a longitudinal direction of the knife 1*d*, and is configured to have an angle $\theta_R$ defined by and between the line L1 and a cutting blade portion 24 on the first blade side 19 (as a half bevel angle at the first blade side 19) different from an angle $\theta_L$ defined by and between the line L1 and a cutting blade portion 23 on a second blade side 21 (as a half bevel angle at the second blade side 21). In this case, $\theta_R<\theta_L$. The knife 1*d* has a skin 7 thin-formed simply on the cutting blade portion 24 at the first blade side 19, like a belt extending along the longitudinal direction of the knife 1*d*. It is noted that though being non-depicted, the line L1 may be offset toward the second blade side 21 from the centerline L of the blade core 5. In this case, $\theta_R>\theta_L$.

Figure 7:
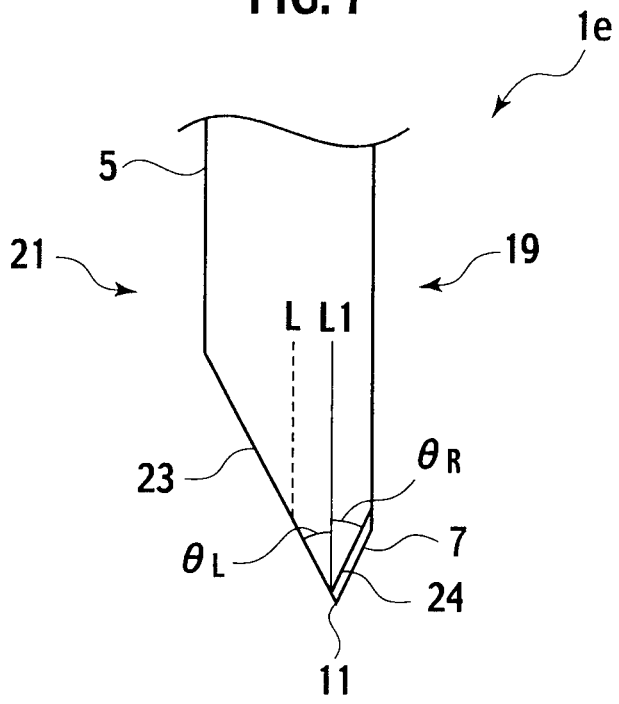
FIG. 7 is a schematic illustration in section of configuration of a knife according to a fourth modification of the second embodiment.

FIG. 7 is a schematic illustration in section of configuration of a knife 1*e* according to a fourth modification of the knife 1*a*. The knife 1*e* has a blade edge tip 11 disposed on a line L1 that is offset toward a first blade side 19 from a centerline L in section of a blade core 5 perpendicular to a longitudinal direction of the knife 1*e*, and is configured to have an angle $\theta_R$ defined by and between the line L1 and a cutting blade portion 24 on the first blade side 19 (as a half bevel angle at the first blade side 19) equal to an angle $\theta_L$ defined by and between the line L1 and a cutting blade portion 23 on a second blade side 21 (as a half bevel angle at the second blade side 21). That is, $\theta_R=\theta_L$. The knife 1*e* has a skin 7 thin-formed simply on an edge region of the cutting blade portion 24 on the first blade side 19, like a belt extending along the longitudinal direction of the knife 1*e*. It is noted that though being non-depicted, the line L1 may be offset toward the second blade side 21 from the centerline L of the blade core 5.

Figure 8:
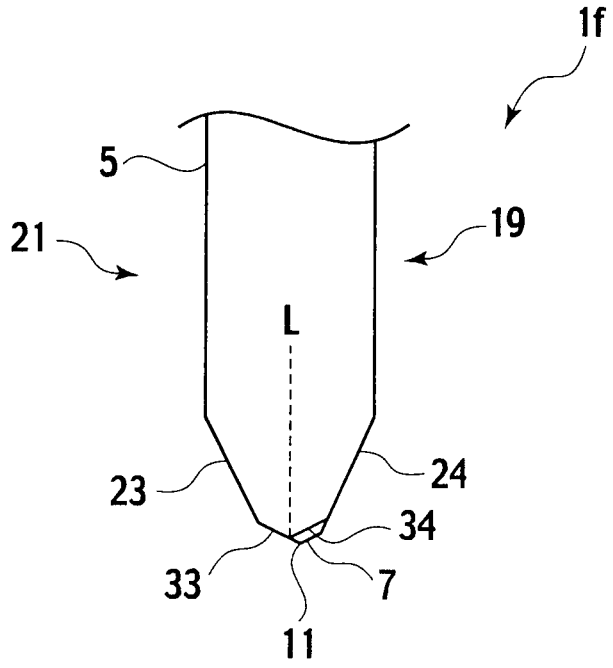
FIG. 8 is a schematic illustration in section of configuration of a knife according to a fifth modification of the second embodiment.

FIG. 8 is a schematic illustration in section of configuration of a knife 1*f* according to a fifth modification of the knife 1*a*. The knife 1*f* has a first blade side 19 with a dual-beveled pair of cutting blade portions 24 and 34 formed thereon, and a second blade side 21 with a dual-beveled pair of cutting blade portions 23 and 33 formed thereon. The knife 1*f* has a thin skin 7 formed simply on the cutting blade portion 34 at the first blade side 19, like a stripe extending along a longitudinal direction of the knife 1*f*. It is noted that though being non-depicted, the skin 7 may be formed simply on the cutting blade portion 33 at the second blade side 21.

Figure 9:
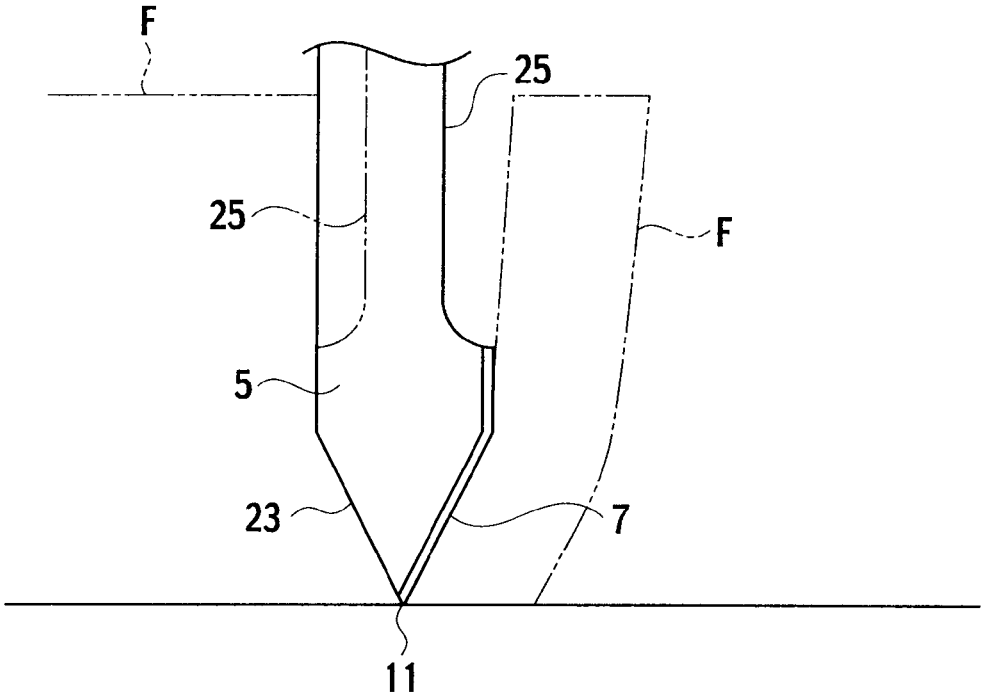
FIG. 9 is an illustration of a knife recessed in part to prevent adhesion of a sliced object.

FIG. 9 illustrates a knife 1*b* according to FIG. 4, as it has recesses 25 formed in part to prevent adhesion of a sliced object F. Such being the case, according to any embodiment described, there may be a knife having a recessed portion 25 provided in part of (a blade core 5 on) at least one side thereof being a first blade side 19, a second blade side 21, or a blade backside 15, to thereby prevent adhesion of a sliced object F. In such a case, the knife can be re-ground with retained sharpness, and the number of repetition times of regrind might be very small, so the recessed portion 25 would not be ground out, thus allowing for a retained prevention of adhesion.

Figure 10:
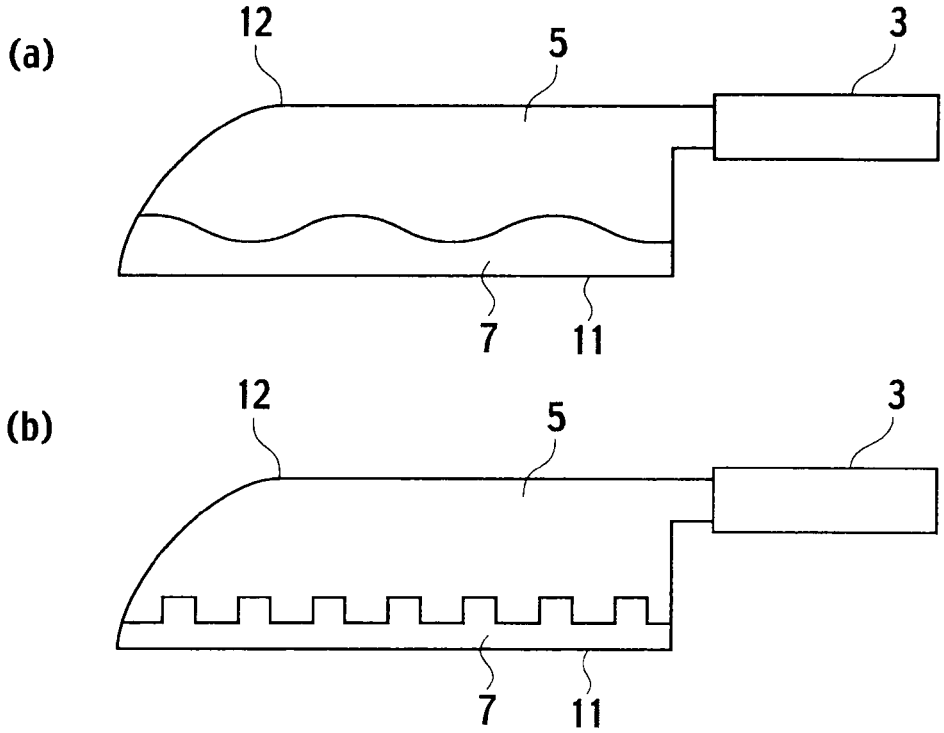
FIG. 10 is a pair of illustrations of knives with modified longitudinal skin patterns, in which FIG. 10(*a*) illustrates a sinusoidal wavy pattern, and FIG. 10(*b*) illustrates a rectangular wavy pattern.

FIGS. 10(*a*) and 10(*b*) are illustrations of knives provided with skins 7 having modified longitudinal patterns. Such being the case, according to any embodiment described, there may be a knife provided with a skin 7 having an undulation, as a pattern of a spine 12 side end line thereof, repeated in a longitudinal direction of the knife.

More specifically, the skin 7 may have, at the side of spine 12, an end line patterned in a sinusoidal waveform as illustrated in FIG. 10(*a*), or in a rectangular waveform as illustrated in FIG. 10(*b*).

According to embodiments in FIG. 10(*a*) or 10(*b*), there is a knife provided with a skin 7 having an undulation, as a pattern of a spine 12 side end line thereof, repeated in a longitudinal direction of the knife, allowing for prevented adhesion of sliced objects, while looking like a pattern of the hardening line in Japanese sword, with the possibility of conveying the impression of being sharp to the owner of knife.

Figure 14:
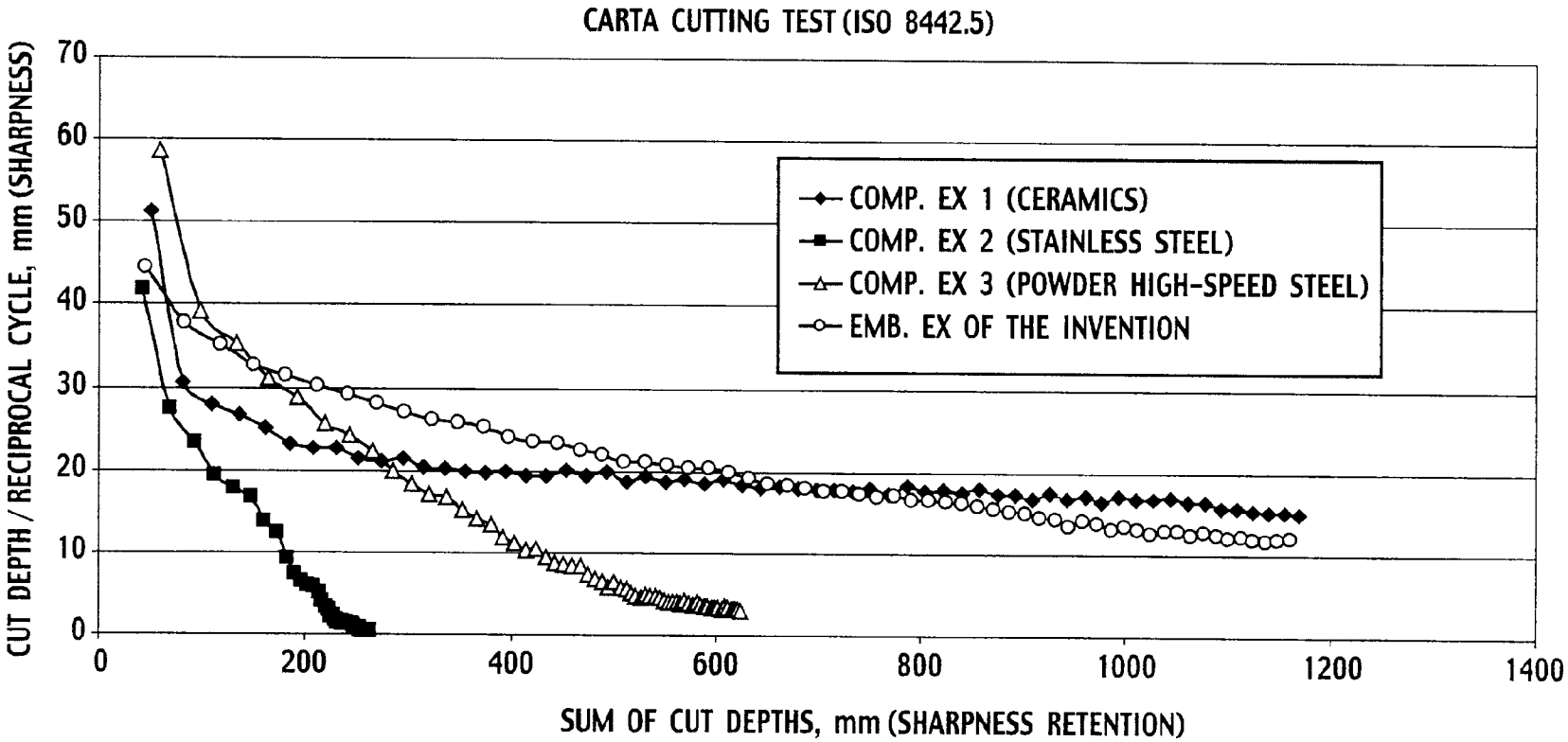
FIG. 14 is a graph plotting results of CATRA cutting tests on sharpness and retention of conventional knives in comparison with a knife according to the present invention.

The final FIG. 14 is a graph plotting results of CATRA cutting tests on sharpness and retention of conventional knives in comparison with a knife according to the present invention. The CATRA cutting test is known as a test of having a knife put on a prescribed test sheet, with the edge contacting thereon, and moved to repeat reciprocating a preset distance, with a constant load imposed thereon, examining a cut depth every cycle. The tests were each made to the ISO8442.5, using a 5% silica paper sheet as the test sheet, with a load of 50 N, at a cutting speed of 50 mm/s, for a reciprocal distance of 40 mm, by a reciprocal cycle number of 60 times. Knives tested were four being a ceramics fabricated knife with a double bevel blade (as a comparative example 1), a stainless steel fabricated knife with a double bevel blade (as a comparative example 2), a powdery high-speed steel fabricated knife with a double bevel blade (as a comparative example 3), and a knife having a double bevel blade according to an example of embodiment of the present invention (as an embodiment example 1).

According to the embodiment example 1, as illustrated in FIG. 5, the knife had a skin 7 formed on a tip region of a cutting blade portion 24 at a first blade side 19. For the skin 7 to be formed on a ferritic stainless steel fabricated blade core 5, there was a mold of ceramics powder employed as an electrode, to have pulsed discharges induced between the electrode and the cutting blade portion 24 by the method described in conjunction with the first embodiment, with evolution of discharge energy causing ceramics powder as an electrode material to be thin-deposited over the tip region (as a stripe region from an edge tip 11 to a height about 3 mm) of the cutting blade portion 24.

FIG. 14 has an axis of ordinate indicating a cut depth (mm) per reciprocal cycle, and an axis of abscissa indicating a sum of cut depths (mm). That is, the axis of ordinate defines an index of sharpness in single cycle of use, as a numerical value, such that the greater the value the better the sharpness in single cycle of use. The axis of abscissa defines an index of retention of sharpness, as a numerical value, such that the greater the value the better the retention of sharpness. It thus so follows that given a characteristic curve the knife should be a better knife to the user, as the curve has a greater value near the left end, and descend rightward with more gentle slopes. From such a point of view, it appears that the embodiment example 1 shows a curve better meeting the condition than curves of the other three knives. Although the knife according to the comparative example 1 (ceramics fabricated knife) is similar in shape of curve to the knife according to the embodiment example 1, the former has a greater drop in fall after initiation of the test in comparison with the latter, so it is find that the knife according to the embodiment example 1 is better in sharpness as well as in retention of sharpness up to a certain time number of use.

Although the foregoing embodiments have been described to implement knives for cutting foods, foodstuffs, or the like, they may be applied also to such cutting instruments (as cutting instruments adapted to work with a blade edge tip pressed on an object to be sliced (as an object to be cut) or with a blade edge tip moved relative to a cutting object, to cut the cutting object) excepting scissors (being cutting instruments using shear forces to cut things), like those encompassing, among others, knives for cutting, beside foods or foodstuffs, yarn, cloth, leather, wood, bamboo, grass, rubber, resin, etc, hooks or sickles for cutting wood, bamboo, grass, etc, saws for cutting wood, bamboo, etc, planes for planing wood, or chisels.

INDUSTRIAL APPLICABILITY

The present invention implements provision of a cutting instrument with sharpness, with an edge difficult to break, allowing for a facilitated fabrication and retained sharpness, as well as a cutting instrument free of slices adhering to the blade.

The invention claimed is:

1. A cutting instrument including a blade core and a cutting blade portion, the cutting instrument comprising:

a skin formed in at least part of the cutting blade portion inclusive of a blade edge tip;

the skin comprising an electrode material or a reaction product of the electrode material, the electrode material having been molten by pulse discharges induced between the blade core and an electrode in a machining oil, having as the electrode one of a mold molded from powder of at least one of a metal, a compound of metal, and a ceramics, a heat-treated mold being the mold as heat-treated, and a solid body of Si; and a gradient composition metal formed between the blade core and the skin, with depths within a range of 5 μm to 30 μm, wherein the blade edge tip is formed into a fine serrated shape caused by a roughness of the skin, and wherein the roughness of the skin is set by a control with a product of a peak current and a pulse width, the product being further divided by a 0.7-th power of a no-load voltage in the pulse discharges.

2. The cutting instrument according to claim 1, wherein the cutting instrument is a knife with a single bevel blade, the cutting blade portion is formed simply on a blade backside, and the skin is formed to cover the cutting blade portion.

3. The cutting instrument according to claim 1, wherein the cutting instrument is a knife with a double bevel blade having a first blade side and a second blade side, the cutting blade portion comprises a first cutting blade portion formed on the first blade side and a second cutting blade portion formed on the second blade side, and the skin is formed to cover at least one of the first and second cutting blade portions.

4. The cutting instrument according to claim 3, wherein the blade edge tip is disposed on a line offset toward one of the first and second blade sides from a centerline in section of the blade core extending in a direction perpendicular to a longitudinal direction of the cutting instrument, and the first cutting blade portion has a half bevel angle different from a half bevel angle of the second cutting blade portion.

5. The cutting instrument according to claim 3, wherein the blade edge tip is disposed on a line offset toward one of the first and second blade sides from a centerline in section of the blade core extending in a direction perpendicular to a longitudinal direction of the cutting instrument, and the first cutting blade portion has a half bevel angle equal to a half bevel angle of the second cutting blade portion.

6. The cutting instrument according to claim 1, wherein the cutting instrument is a knife with a double bevel blade having a first blade side and a second blade side, the cutting blade portion comprises a first cutting blade portion formed on the first blade side and a second cutting blade portion formed on the second blade side, the first and second cutting blade portions being dual-beveled toward the blade edge tip, respectively, and the skin is formed to cover a bevel nearer to the blade edge tip on one of the first and second cutting blade portions.

7. The cutting instrument according to claim 1, wherein the cutting instrument is a knife with a double bevel blade having a first blade side and a second blade side, the cutting blade portion comprises a first cutting blade portion formed on the first blade side and a second cutting blade portion formed on the second blade side, and the skin is formed on at least part of one of the first and second cutting blade portions with the blade edge tip inclusive.

8. The cutting instrument according to claim 1, wherein the blade core has a recessed portion provided in at least part thereof exclusive of the cutting blade portion.

9. The cutting instrument according to claim 1, wherein the skin has an end line thereof opposite the blade edge tip, the end line being shaped to an undulation pattern.

10. The cutting instrument according to claim 1, wherein the mold comprises at least one of Ti, Si, cBN, TiC, WC, SiC, $Cr_3C_2$, $Al_2O_3$, $ZrO_2$—Y, TiN, and TiB.

11. The cutting instrument according to claim 1, wherein the blade core comprises ferritic stainless steel.

12. The cutting instrument according to claim 11, wherein the cutting blade portion is provided on the blade core.

13. The cutting instrument according to claim 11, wherein the skin comprises a composite mixed with a material of the blade core.

* * * * *